US009469104B2

(12) United States Patent
Fukuda

(10) Patent No.: US 9,469,104 B2
(45) Date of Patent: Oct. 18, 2016

(54) LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/455,778

(22) Filed: Aug. 8, 2014

(65) Prior Publication Data

US 2015/0042710 A1 Feb. 12, 2015

(30) Foreign Application Priority Data

Aug. 12, 2013 (JP) ..... 2013-167394
Feb. 21, 2014 (JP) ..... 2014-031305

(51) Int. Cl.
*B41J 2/045* (2006.01)

(52) U.S. Cl.
CPC ..... *B41J 2/04588* (2013.01); *B41J 2/04581* (2013.01); *B41J 2/04593* (2013.01)

(58) Field of Classification Search
CPC ..... B41J 2/04588
See application file for complete search history.

(56) References Cited

U.S. PATENT DOCUMENTS 6,217,159 B1 * 4/2001 Morikoshi et al. ..... 347/71
6,450,603 B1 * 9/2002 Chang ..... B41J 2/0457 347/11
6,485,133 B1 * 11/2002 Teramae et al. ..... 347/68
2003/0085962 A1 * 5/2003 Junhua ..... B41J 2/04581 347/68
2005/0030352 A1 * 2/2005 Murai et al. ..... 347/72
2006/0238554 A1 10/2006 Hosono et al.
2009/0225141 A1 * 9/2009 Suzuki ..... 347/85
2011/0148962 A1 * 6/2011 Kaneko ..... 347/10
2013/0033534 A1 * 2/2013 Takano ..... B41J 29/38 347/10

FOREIGN PATENT DOCUMENTS

EP 1 088 662 4/2001
JP 2001-138551 5/2001

OTHER PUBLICATIONS

European Search Report for Application No. 14179878.5 dated Jan. 26, 2015.

* cited by examiner

*Primary Examiner* — Shelby Fidler
(74) *Attorney, Agent, or Firm* — Workman Nydegger

(57) ABSTRACT

A drive signal includes a first drive pulse that causes liquid droplets to be ejected from nozzles and a second drive pulse that causes liquid droplets of a different size from those of the first drive pulse to be ejected from the nozzles. The drive pulses have expansion elements that expand a pressure chamber, contraction elements that contract a pressure chamber, and vibration control elements. An initiation potential of the contraction element of the first drive pulse and an initiation potential of the contraction element of the second drive pulse are the same. The differential voltage between the standard potential and the contraction potential is set to between 40% 50% or less of the potential between the initiation potential of the contraction element and the contraction potential.

5 Claims, 6 Drawing Sheets

| D1 (%) | 37 | 38 | 39 | 40 | 42 | 45 | 47 | 50 | 51 | 52 | 53 |
|---|---|---|---|---|---|---|---|---|---|---|---|
| MIST AMOUNT | ○ | ○ | ○ | ○ | ○ | ○ | ○ | ○ | △ | △ | × |

| D1 (%) | 37 | 38 | 39 | 40 | 42 | 45 | 47 | 50 | 51 | 52 | 53 |
|---|---|---|---|---|---|---|---|---|---|---|---|
| DEGREE OF VARIATION IN INK AMOUNT | × | × | △ | ○ | ○ | ○ | ○ | ○ | ○ | ○ | ○ |

LIQUID EJECTING APPARATUS

BACKGROUND

1. Technical Field

The present invention relates to a liquid ejecting head that causes liquid droplets to be ejected from nozzles by supplying a drive signal to a piezoelectric body. The present invention also relates to a driving method for the liquid ejecting head, a liquid ejecting apparatus that is provided with the liquid ejecting head, and a driving method for the liquid ejecting apparatus.

2. Related Art

A liquid ejecting apparatus is an apparatus that is provided with a liquid ejecting head that is capable of ejecting a liquid in the form of liquid droplets from nozzles, and which liquid ejecting apparatus ejects various kinds of liquids from the liquid ejecting head. For example, as representative examples of this kind of liquid ejecting apparatus, there are image recording apparatuses (hereinafter, referred to as printers) such as ink jet recording apparatuses that are provided with an ink jet recording head (hereinafter, referred to as a recording head), and that perform recording by ejecting ink in liquid form as ink droplets from nozzles of the recording head. Further, in addition to the above, liquid ejecting apparatuses are used in the ejecting of various types of liquids such as coloring materials that are used in color filters for liquid crystal displays and the like, organic materials that are used in organic EL (Electro Luminescence) displays, and electrode materials that are used in electrode formation. Further, liquid ink is ejected from recording heads in image recording apparatuses, and solutions of the respective color materials of R (Red), G (Green) and B (Blue) are ejected from color material ejecting heads in display production apparatuses. In addition, a liquid electrode material is ejected from electrode material ejecting heads in electrode formation apparatuses, and solutions of living organic matter are ejected from living organic matter ejecting heads in chip production apparatuses.

A recording head (such as that mentioned above) is provided with a piezoelectric element that brings about pressure fluctuations in ink inside a pressure chamber. The piezoelectric element has a common electrode that is common to a plurality of piezoelectric elements, an individual electrode that is patterned individually in each piezoelectric element, and a piezoelectric body layer (piezoelectric body film) that is interposed between these electrodes. A flexible cable is electrically connected to terminals of the common electrode and the individual electrode. When a drive signal (drive voltage) is supplied between the common electrode and the individual electrode through the flexible cable, a potential-dependent electrical field is created between the two electrodes. The piezoelectric element (piezoelectric body film) for example bends and deforms depending on the intensity of the electrical field, and a pressure fluctuation is applied on ink inside the pressure chamber. Further, the recording head ejects ink droplets from nozzles that extend through the pressure chamber by using the pressure fluctuation. Additionally, normally, a constant potential is applied to the common electrode, and an oscillatory waveform is applied to the individual electrode.

In addition, the abovementioned drive signal may include a series of drive pulses with different waveforms in order to enable multi-gradation recording by changing the size (or number) of dots that are formed in a predetermined region (a pixel region) of a recording medium (a landing target) such as recording paper. For example, the drive signal that is shown in FIG. 9 is provided with a large dot drive pulse PL that forms large dots on a recording medium (landing target) (such as recording paper) by ejecting comparatively large ink droplets, and a small dot drive pulse PS that forms small dots on the recording medium by ejecting comparatively small ink droplets in a unit period, which is a repeating period. Both drive pulses PL and PS are provided with expansion elements p81 and p91 that cause a pressure chamber to expand by changing from an intermediate potential VC (a potential that is halfway between a highest potential and a lowest potential), which is a standard, to expansion potentials VLL and VLS. Both drive pulses PL and PS are also provided with expansion retention elements p82 and p92 that retain the expanded pressure chamber for a set period of time by retaining the expansion potentials VLL and VLS. Both drive pulses PC and PS are also provided with contraction elements p83 and p93 that cause the expanded pressure chamber to contract by changing from the expansion potentials VLL and VLS to contraction potentials VHL and VHS. Further, ink droplets are ejected from the nozzles by using pressure fluctuations in the pressure chamber that are brought about by the contraction elements p83 and p93. In addition, both drive pulses PL and PS are provided with vibration control elements p84 and p94 in order to control pressure vibrations (residual vibrations) in the pressure chamber that are brought about after the ejection of the ink droplets. The vibration control elements p84 and p94 are elements that for example, change from the contraction potentials VHL and VHS to the intermediate potential VC, and are capable of controlling residual vibrations. As a result of this, it is possible to suppress circumstances in which the ejecting properties of ink droplets change due to residual vibrations when ejecting ink droplets continuously.

In addition, a difference in potential between the expansion potentials VLL and VLS and the contraction potentials VHL and VHS in each of drive pulse PL and PS is optimized (set) so that an intended amount of ink droplets is ejected. More specifically, a difference in potential between the expansion potentials VLL and VLS and the contraction potentials VHL and VHS is set to match the properties of the recording head. For example, in the drive signal that is shown as an example in FIG. 9, a difference in potential (a maximum difference in potential) between the expansion potential VLS and the contraction potential VHS of the small dot drive pulse PS is set to be greater than a difference in potential (a maximum difference in potential) between the expansion potential VLL and the contraction potential VHL of the large dot drive pulse PL. In two such drive pulses PL and PS in which the difference in potential between the expansion potentials VLL and VLS and the contraction potentials VHL and VHS is different, the end terminal potentials and the start terminal potentials are made to be uniform at the same intermediate potential VC. Further, an end terminal potential of a previous drive pulse is connected to a start terminal potential of a subsequent drive pulse.

Given that, with respect to the piezoelectric properties of the piezoelectric body layer (the piezoelectric body), it is known that an amount of displacement (an amount of deformation), with respect to a drive voltage (a difference in potential between the common electrode and the individual electrode) that is applied, has a non-linear property (more specifically, a hysteretic property). In the piezoelectric properties of this kind of piezoelectric body layer, a linear region is present in a certain region of the drive potential in which the piezoelectric properties have a linearity that is substantially close to a straight line. For example, in the piezoelectric properties of a piezoelectric body layer that is shown as an example in FIG. 8, a linear region L (a portion that is enclosed by a dashed line in FIG. 8) is present in the vicinity of where the drive voltage is 0. In this linear region L, a ratio of the amount of displacement with respect to the drive voltage is larger than non-linear regions other than the linear region L. Therefore, it is desirable to as often as possible adjust the drive signal so that the piezoelectric body is driven in the linear region L that is in the piezoelectric properties thereof.

On the other hand, in the piezoelectric properties of this kind of piezoelectric body layer, there are circumstances in which the properties deviate from expected piezoelectric properties due to variation at the time of production and the like. When the piezoelectric properties of the piezoelectric body layer deviate, there is a concern that the ejecting properties of ink droplets that are ejected from the nozzles will deviate from the properties that are originally expected. Therefore, an apparatus has been suggested (for example, refer to JP-A-2001-138551) that is configured so as to set the intermediate potential of the drive signal (drive pulses) that is applied to the piezoelectric element to an optimum potential so as to suppress the influence of variations in the properties (the piezoelectric properties of the piezoelectric body layer) of the piezoelectric element of each recording head. That is, it is more convenient to adjust the intermediate potential than to adjust the potentials or slopes of the constituent elements of the drive pulses.

However, in a drive signal that has two or more pulses in which the differences in potential between the expansion potential and the contraction potential differ, there is a concern that by adjusting the intermediate potential VC in the abovementioned manner, one drive pulse will deviate from optimum conditions if another of the drive pulses is adjusted so as to match optimum conditions at which optimum ejection is performed. For example, in a case in which the piezoelectric body layer has piezoelectric properties such as those shown in FIG. 8, in the drive signal that is shown in FIG. 9, the expansion potential VLS of the small dot drive pulse PS matches a drive voltage V1 of the piezoelectric properties, the contraction potential VHS matches a drive voltage V4. In contrast, the expansion potential VLL of the large dot drive pulse PL matches a drive voltage V2 that is higher than the drive voltage V1, and the contraction potential VHL matches a drive voltage V3 that is lower than the drive voltage V4. That is, the large dot drive pulse PL is used in a range of the drive voltages V2 to V3 in the piezoelectric properties that are shown in FIG. 8, and the small dot drive pulse PS is used in a range of the drive voltages V1 to V4. In this case, for example, consider the case in which the potential of the large dot drive pulse PL is uniformly shifted to a lower potential side in order to make the potential match a potential for driving that aims to drive using the large dot drive pulse PL. That is, in order to match driving in which efficiency is as favorable as possible in consideration of a balance between the amount of expansion and the amount of contraction of the pressure chamber, the intermediate potential VC is shifted to a low potential side. As a result of this, the expansion potential VLS of the small dot drive pulse PS is shifted to a region in which the slope of the piezoelectric properties is smaller than the V1 (a region in which a ratio of the amount of displacement with respect to the drive voltage is small), and the contraction potential VHS is shifted to a region in which the inclination of the piezoelectric properties is larger than the V4 (a region in which a ratio of the amount of displacement with respect to the drive voltage is large). Therefore, driving using the small dot drive pulse PS deviates from the ideal driving that is aimed for. That is, while the large dot drive pulse PL can drive the piezoelectric body layer with the intended driving conditions, the small dot drive pulse PS drives the piezoelectric body layer with driving conditions that deviate from the intended driving conditions. In particular, since there is a tendency for a range of the vibration control element p94 to change on a high potential side in the piezoelectric properties, there is a tendency for the intensity (the intensity of the pressure fluctuations of the pressure chambers) of the vibration control due to the vibration control element p94 to deviate from the properties that are originally intended. Therefore, when the intermediate potential is adjusted depending on variation in the properties of the piezoelectric element (the piezoelectric body layer), the intensity of the vibration control (due to the vibration control elements) varies for each piezoelectric element.

In particular, in recent years, the thinning of piezoelectric body layers (piezoelectric bodies) has been progressing along with the miniaturization of recording heads. If the film thickness of the piezoelectric body layer is reduced, since the linear region L in the piezoelectric properties of the piezoelectric body layer becomes smaller (or in other words, since the non-linear region becomes larger), it becomes more likely that a used range of the drive voltages will be in the non-linear region due to the adjustment of the ranges of the drive voltages with respect to other drive pulses. As a result of this, the abovementioned variation in vibration control elements in particular, becomes significant.

In this case, in the manner mentioned above, since the vibration control element is an element for controlling vibration of a meniscus after the ejection of the ink droplets, there is a concern that mist (minute ink droplets) will be generated due to the application of the vibration control element. To explain in more detail, if the vibration control element is applied, since a pulling force works on the meniscus in a direction that is opposite a movement direction of the meniscus, there is a concern that minute ink droplets will become separated from a portion of the meniscus. These kinds of ink droplets are turned into mist, float inside the printer, and adhere to members that are easily electrified (such as the recording head and electrical circuits). As a result of this, there is a concern that operational defects of the printer will be generated. In order to suppress such defects, the suppression of the generation of mist through optimization of the vibration control elements has been considered. However, as mentioned above, since the intensity of the vibration control due to the vibration control elements varies due to variation in the properties of the piezoelectric element, it is not possible to sufficiently suppress the generation of mist.

SUMMARY

An advantage of some aspects of the invention is to provide a liquid ejecting head that is capable of suppressing the generation of mist, a driving method for the liquid ejecting head, a liquid ejecting apparatus that is provided with the liquid ejecting head, and a driving method for the liquid ejecting apparatus.

A liquid ejecting apparatus of an aspect of the present invention includes a liquid ejecting head that has a piezoelectric body that deforms due to a drive signal being applied thereto, and is capable of ejecting liquid droplets from nozzles by bringing about a pressure fluctuation in a liquid inside a pressure chamber by using the deformation of the piezoelectric body, and a drive signal generator that generates the drive signal. The drive signal includes a first drive pulse that causes liquid droplets to be ejected from the nozzles and a second drive pulse that causes liquid droplets of a different size from those of the first drive pulse to be ejected from the nozzles, the first drive pulse and the second drive pulse have at least an expansion element that causes the pressure chamber to expand from a standard capacity by changing from a standard potential, which is a standard for changes in potential, to an expansion potential, a contraction element that causes the pressure chamber to contract by exceeding the standard potential from a potential that is on an expansion potential side of the standard potential, thereby ejecting the liquid, and a vibration control element that controls pressure vibrations in the pressure chamber that are brought about after the ejection of the liquid by changing from the contraction potential to the standard potential, an initiation potential of the contraction element of the first drive pulse and an initiation potential of the contraction element of the second drive pulse are made to be uniform at the same potential, and a difference in potential between the standard potential and the contraction potential of the first drive pulse and the second drive pulse is set to 40% or more and 50% or less with respect to a difference in potential between the initiation potential of the contraction element and the contraction potential.

According to the aspect of the present invention, it is possible to match both the initiation potential of the contraction element of the first drive pulse and the initiation potential of the contraction element of the second drive pulse with an intended drive voltage in the piezoelectric properties of the piezoelectric body. As a result of this, it is possible to configure driving of the piezoelectric body by both drive pulses as optimal driving that matches the piezoelectric properties of the piezoelectric body. That is, since the initiation potentials of the contraction elements that cause liquid to be ejected in both drive pulses are also made to be uniform in cases in which the standard potential is increased or decreased in order to adjust one drive pulse to an intended driving range in the piezoelectric properties, it is possible to suppress a circumstance in which the other of the drive pulses deviates from a range of an intended drive voltage in the piezoelectric properties. As a result of this, it is possible to configure driving of the piezoelectric body using both drive pulses and the vibration control element in particular to a target extent. In addition, since the initiation potentials of the contraction elements of both drive pulses are made to be uniform, it is possible to use an effective drive voltage range in the piezoelectric properties of the piezoelectric body sufficiently in both drive pulses, and it is possible to suppress a circumstance in which the vibration control element deviates greatly on a high voltage side. As a result of this, it is possible to suppress a circumstance in which the driving range of the piezoelectric properties of the vibration control element varies for each piezoelectric body, and it is possible to stabilize pressure fluctuations of the pressure chambers due to the vibration control element. In addition to this, in the first drive pulse and the second drive pulse, a difference in potential between the standard potential and the contraction potential is set to 40% or more and 50% or less with respect to a difference in potential between the initiation potential of the contraction element and the contraction potential, and therefore it is possible to suppress the generation of mist and it is also possible to stabilize the ejection of the liquid droplets.

In addition, in the abovementioned configuration, it is desirable that the drive signal include a third drive pulse that causes liquid droplets of a different size from those of the first drive pulse and the second drive pulse to be ejected from the nozzles, the third drive pulse have at least an expansion element that causes the pressure chamber to expand from a standard capacity by changing from a standard potential, which is a standard for changes in potential, to an expansion potential, a contraction element that causes the pressure chamber to contract by exceeding the standard potential from a potential that is on an expansion potential side of the standard potential, thereby ejecting the liquid, and a vibration control element that controls pressure vibrations in the pressure chamber that are brought about after the ejection of the liquid by changing from the contraction potential to the standard potential, an initiation potential of the contraction element of the third drive pulse be made to be uniform at the same potential as the initiation potential of the contraction element of the first drive pulse and the initiation potential of the contraction element of the second drive pulse, and in the third drive pulse, a difference in potential between the standard potential and the contraction potential be set to 40% or more and 50% or less with respect to a difference in potential between the initiation potential of the contraction element and the contraction potential.

According to this configuration, since liquid droplets of different sizes are ejected by each drive pulse, multi-gradation recording is possible. In addition, in this case, it is likely that a range of changes in potential (a range from the highest potential to the lowest potential) will differ for each drive pulse, but it is also possible to suppress variation in the driving range in the piezoelectric properties of the vibration control element in such a case, and it is possible to stabilize pressure fluctuations of the pressure chambers due to the vibration control element. In addition to this, regarding each drive pulse, a difference in potential between the standard potential and the contraction potential is set to 40% or more and 50% or less with respect to a difference in potential between the initiation potential of the contraction element and the contraction potential, and therefore, it is possible to more reliably suppress the generation of mist.

Furthermore, in the abovementioned configuration, it is desirable that the third drive pulse cause liquid droplets that are smaller than those of the first drive pulse and larger than those of the second drive pulse to be ejected from the nozzles.

In addition, it is desirable that the drive signal include a third drive pulse that causes liquid droplets of the same size as those of the first drive pulse to be ejected from the nozzles, the third drive pulse have at least an expansion element that causes the pressure chamber to expand from a standard capacity by changing from a standard potential, which is a standard for changes in potential, to an expansion potential, a contraction element that causes the pressure chamber to contract by exceeding the standard potential from a potential that is on an expansion potential side of the standard potential, thereby ejecting the liquid, and a vibration control element that controls pressure vibrations in the pressure chamber that are brought about after the ejection of the liquid by changing from the contraction potential to the standard potential, an initiation potential of the contraction element of the third drive pulse be made to be uniform at the same potential as the initiation potential of the contraction element of the first drive pulse and the initiation potential of the contraction element of the second drive pulse, and in the third drive pulse, a difference in potential between the standard potential and the contraction potential is set to 40% or more and 50% or less with respect to a difference in potential between the initiation potential of the contraction element and the contraction potential.

Furthermore, in the abovementioned configuration, it is desirable that the first drive pulse and the third drive pulse cause liquid droplets that are larger than those of the second drive pulse to be ejected from the nozzles.

Furthermore, in the abovementioned configuration, it is desirable that each drive pulse be set so that the difference in potential between the standard potential and the contraction potential is 45% with respect to the difference in potential between the initiation potential of the contraction element and the contraction potential.

According to this configuration, it is possible to more reliably suppress the generation of mist, and it is possible to stabilize the ejection of the liquid droplets.

In addition, in the abovementioned configuration, it is desirable that the piezoelectric body be formed in a film-shape in which crystal is preferentially oriented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment for implementing the present invention will be described with reference to the appended drawings. Additionally, in the embodiments that will be described below, various limitations are given as preferred specific examples of the present invention, but the scope of the present invention is not limited to these aspects unless a feature that limits the present invention is specifically stated in the following description. In addition, in the following description, an ink jet type recording apparatus (hereinafter, referred to as a printer 1) is used as an example of a liquid ejecting apparatus of the present invention.

Figure 1:
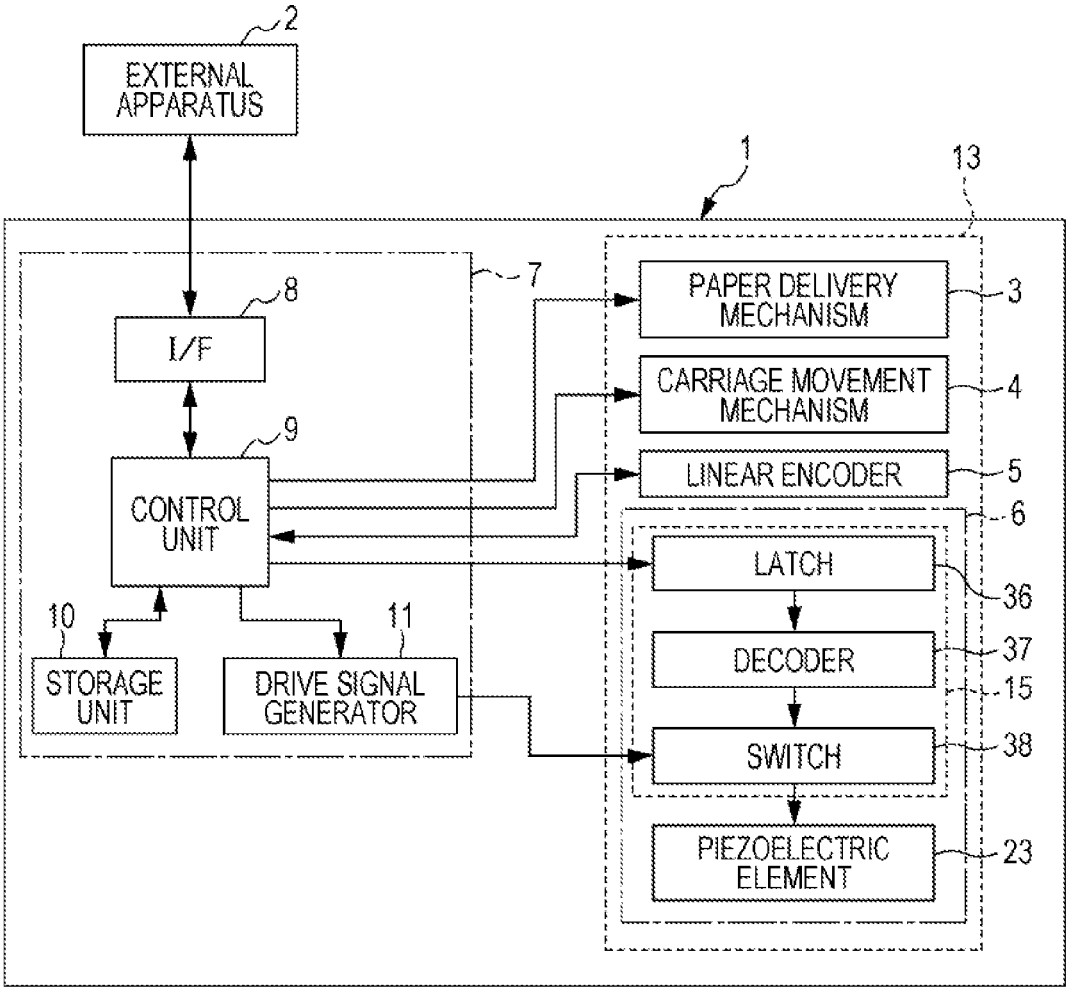
FIG. 1 is a block diagram that describes an electrical configuration of a printer.
Figure 2:
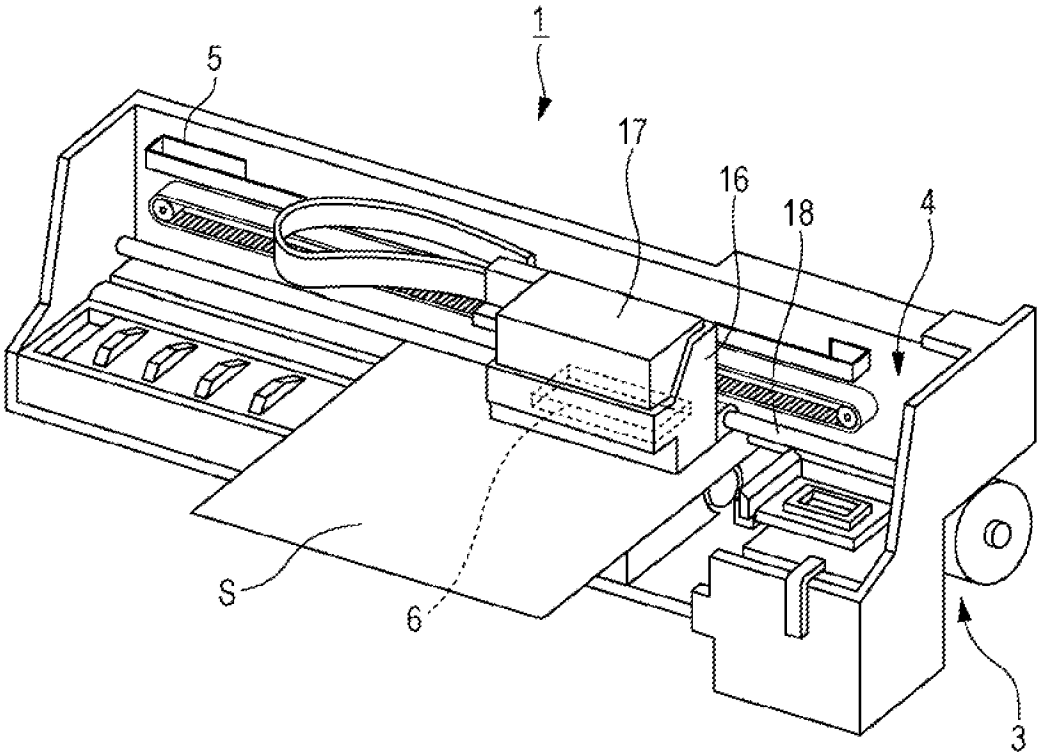
FIG. 2 is a perspective view that describes an internal configuration of a printer.

FIG. 1 is a block diagram that describes an electrical configuration of a printer 1 and FIG. 2 is a perspective view that describes an internal configuration of the printer 1. An external apparatus 2 is for example, an electronic device such as a computer, a digital camera, a cellular phone, or a mobile data terminal device. The external apparatus 2 is electrically connected to the printer 1 with either a wired or wireless connection, and sends printing data that represents an image or text to the printer 1 in order to print the image or the like on a recording medium S such as recording paper in the printer 1.

The printer 1 of the present embodiment includes a printing engine 13 such as a paper delivery mechanism 3, a carriage movement mechanism 4, a linear encoder 5, and a recording head 6, and a printer controller 7. The recording head 6 is attached to a bottom surface side of a carriage 16 on which ink cartridges 17 (liquid supply sources) are mounted. Further, the carriage 16 is configured to be capable of reciprocating movement along a guide rod 18 using the carriage movement mechanism 4. That is, the printer 1 sequentially transports the recording medium S (a kind of landing target) such as recording paper using the paper delivery mechanism 3, and lands ink on the recording medium S by ejecting the ink from nozzles 25 (refer to FIG. 3) of the recording head 6 while relatively moving the recording head 6 with respect to the recording medium S in a width direction (a main scanning direction) of the recording medium S, thereby recording images or the like. Additionally, it is possible to adopt a configuration in which the ink cartridges are disposed on a main body side of the printer, and ink from the ink cartridges is delivered to a recording head side through supply tubes.

The printer controller 7 is a control unit that performs the control of the various units of the printer 1. The printer controller 7 in the present embodiment includes an interface (I/F) unit 8, a control unit 9, a storage unit 10 and a drive signal generator 11 (corresponding to the drive signal generator of the present invention). The interface unit 8 performs the transmission and reception of status data of the printer 1 when printing data or printing commands are sent from the external apparatus 2 to the printer 1, when status information of the printer 1 is output to the external apparatus 2, or the like. The control unit 9 is an arithmetic processing unit for performing overall control of the printer 1. The storage unit 10 is an element that stores programs of the control unit 9 and data that is used in various controls, and includes ROM, RAM and NVRAM (non-volatile storage elements). The control unit 9 controls each unit according to the programs that are stored in the storage unit 10. In addition, the control unit 9 in the present embodiment generates ejection data, which indicates from which nozzles 25 and at what timing to eject ink during a recording action, on the basis of image data from the external apparatus 2, and sends the ejection data to a head control unit 15 of the recording head 6. The drive signal generator 11 generates an analog signal on the basis of waveform data that is related to a waveform of a drive signal, and generates a drive signal COM such as that shown in FIG. 4 by amplifying the signal.

Next, the printing engine 13 will be described. As shown in FIG. 1, the printing engine 13 is provided with the paper delivery mechanism 3, the carriage movement mechanism 4, the linear encoder 5, the recording head 6 and the like. The carriage movement mechanism 4 is formed from the carriage 16 to which the recording head 6 is attached as a type of liquid ejecting head, a drive motor (for example, a DC motor), which causes the carriage 16 to travel using a timing belt or the like, and the like (neither of which are shown in the drawings), and causes the recording head 6 that is mounted to the carriage 16 to move in a main scanning direction. The paper delivery mechanism 3 is formed from a paper delivery motor, a paper delivery roller and the like, and performs sub scanning by sequentially sending recording medium S out onto a platen. In addition, the linear encoder 5 outputs an encoder pulse that depends on a scanning position of the recording head 6 that is mounted to the carriage 16 to the printer controller 7 as position information in the main scanning direction. The control unit 9 of the printer controller 7 can ascertain the scanning position (current position) of the recording head 6 on the basis of the encoder pulse that is received from the linear encoder 5 side. In addition, the control unit 9 generates a timing signal (latch signal), which stipulates a generation timing of a drive signal COM (to be described later), on the basis of the encoder pulse.

Figure 3:
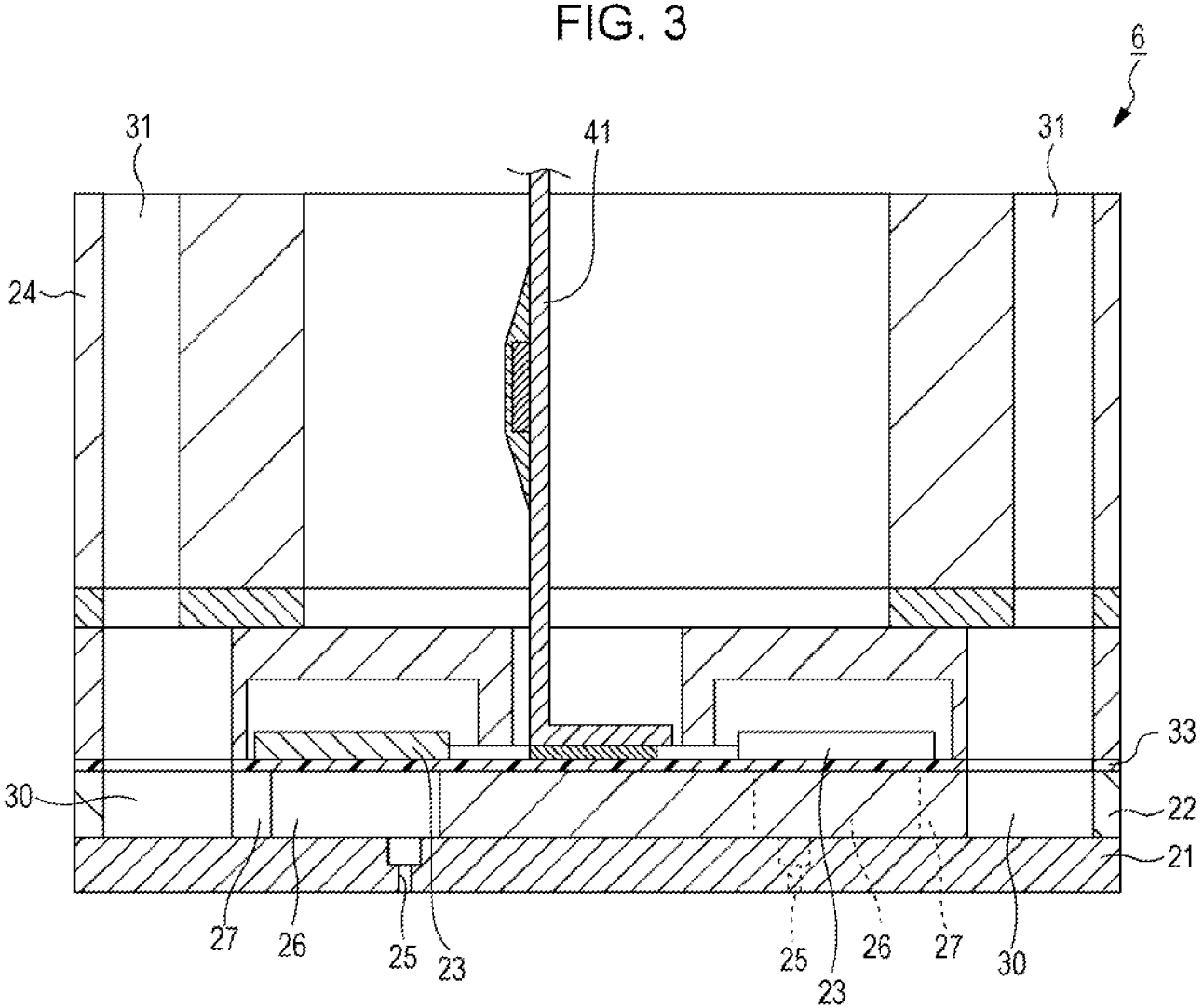
FIG. 3 is a cross-sectional view that describes a configuration of a recording head.

FIG. 3 is a main portion cross-sectional view that describes an internal configuration of the recording head 6. The recording head 6 of the present embodiment is configured from a nozzle plate 21, a flow channel substrate 22, a piezoelectric element 23 and the like, and is attached to a case 24 in a state in which these members are laminated. The nozzle plate 21 is a plate-shaped member in which a plurality of nozzles 25 are provided in row form in an open manner with a predetermined pitch. In the present embodiment, two nozzle rows, which are configured from the plurality of nozzles 25 that are arranged in parallel, are arranged in parallel in the nozzle plate 21.

The flow channel substrate 22 is a plate material that is formed from a silicon monocrystalline substrate or the like. A plurality of pressure chambers 26 are formed in the flow channel substrate 22 lined up in a nozzle row direction. Each pressure chamber 26 is provided on a one-to-one basis to correspond to each nozzle 25 of the nozzle plate 21. That is, the formations pitch of each pressure chamber 26 corresponds to the formation pitch of the nozzles 25. In the present embodiment, two pressure chamber rows are provided to correspond to the two nozzle rows. In addition, reservoirs 30 that penetrate through the flow channel substrate 22 are formed along a parallel arrangement direction of the pressure chambers 26 in a region that is separated from a side that is opposite a communication side of the nozzle 25 with the pressure chamber 26. The reservoir 30 is an empty part that is common to each pressure chamber 26 that belongs to the same pressure chamber row. The reservoirs 30 and each pressure chamber 26 are respectively in communication with one another via ink supply openings 27 that are formed with a width that is narrower than that of the pressure chambers 26. Additionally, ink from an ink cartridge 17 side is introduced into the reservoirs 30 through ink supply channels 31 of the case 24.

The nozzle plate 21 is joined to a bottom surface (a surface that is opposite a piezoelectric element 23 side) of the flow channel substrate 22 using an adhesive, a heat welding film or the like. The nozzle plate 21 is a plate material in which the plurality of nozzles 25 are provided in row form in an open manner with a predetermined pitch. In the present embodiment, a nozzle row is configured by lining up 360 nozzles 25 at a pitch that corresponds to 360 dpi. Each nozzle 25 is in communication with the pressure chamber 26 at an end part of a side that is opposite the ink supply opening 27. Additionally, the nozzle plate 21 is for example, formed from glass ceramics, a silicon monocrystalline substrate, stainless steel or the like. In the recording head 6 of the present embodiment, a total of two nozzle rows are provided, and a liquid flow channel that corresponds to each nozzle row is provided in a bilaterally symmetrical manner with the nozzle 25 side on the inside thereof.

The piezoelectric element 23 is formed on an upper surface of a side that is opposite a nozzle plate 21 side of the flow channel substrate 22 via an elastic film 33. That is, an opening of an upper part of each pressure chamber 26 is blocked by the elastic film 33, and the piezoelectric element 23 is further formed thereon. The piezoelectric element 23 is formed by sequentially laminating a metal lower electrode film, a piezoelectric body layer (a piezoelectric body film) in which a piezoelectric body is formed in film-shape, and an upper electrode film (none of which are shown in the drawings) that is formed from metal. It is preferable that crystal be oriented as the piezoelectric body layer. For example, in the present embodiment, a piezoelectric body layer that is used is one in which crystal is oriented by formation using a so-called sol-gel method that obtains a piezoelectric body layer that is formed from a metal oxide by applying and drying, then gelatinizing a so-called sol in which a metal organic material has been dissolved or dispersed in a catalyst, and further firing the product at a high temperature. A lead zirconate titanate material is preferable as the material of the piezoelectric body layer in a case of use in an ink jet type recording head. Additionally, the film formation method of the piezoelectric body layer is not particularly limited, and for example, the piezoelectric body layer may be formed by a sputtering method. In addition, the film formation method may use a method that grows crystals in an aqueous alkali solution at a low temperature using a high pressure treatment method after forming a lead zirconate titanate precursor film using a sol-gel method, a sputtering method or the like.

Regardless of the method used, in a piezoelectric body layer that is formed in this manner, as opposed to so-called bulk piezoelectric bodies, crystals are preferentially oriented, and in the present embodiment, crystals are formed in pillar form in the piezoelectric body layer. Additionally, preferential orientation refers to a state in which a specific crystal surface is arranged in a substantially constant direction rather than the orientation direction of crystals being disordered. In addition, a thin film with pillar-shaped crystals refers a state in which a thin film is formed by aggregation of substantially cylindrical crystals are formed by aggregation over a surface direction in a state in which the central axes thereof are substantially uniform in a thickness direction. Naturally, a thin film that is formed by preferentially oriented granular crystals may also be used. Additionally, the thickness of a piezoelectric body layer that is produced with this kind of a thin film step is generally 0.5 to 5 μm.

Figure 8:
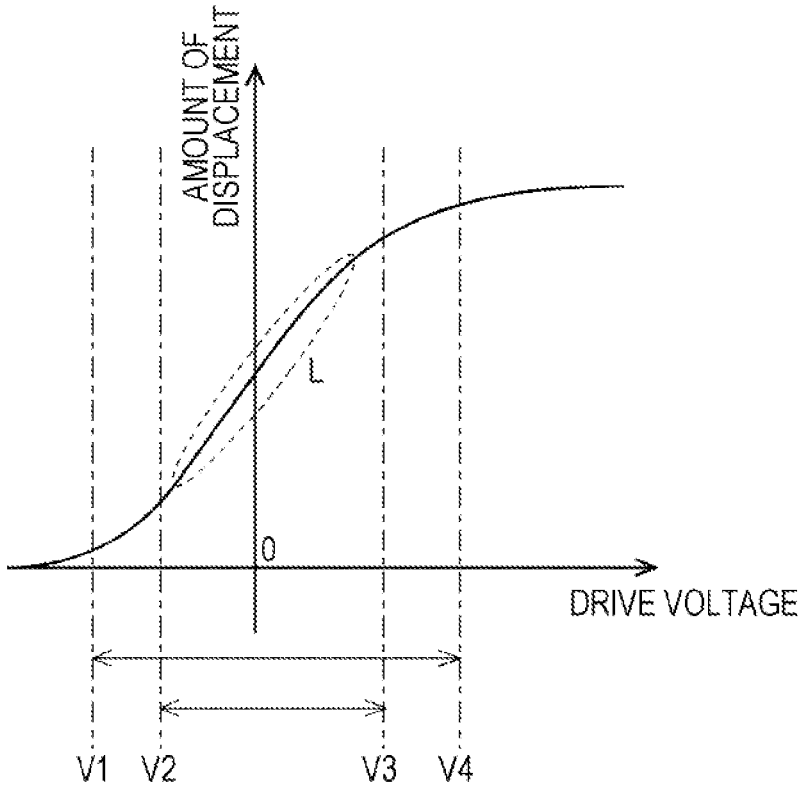
FIG. 8 is a characteristic diagram that shows a relationship between a drive voltage and an amount of displacement of a piezoelectric body.
Figure 9:
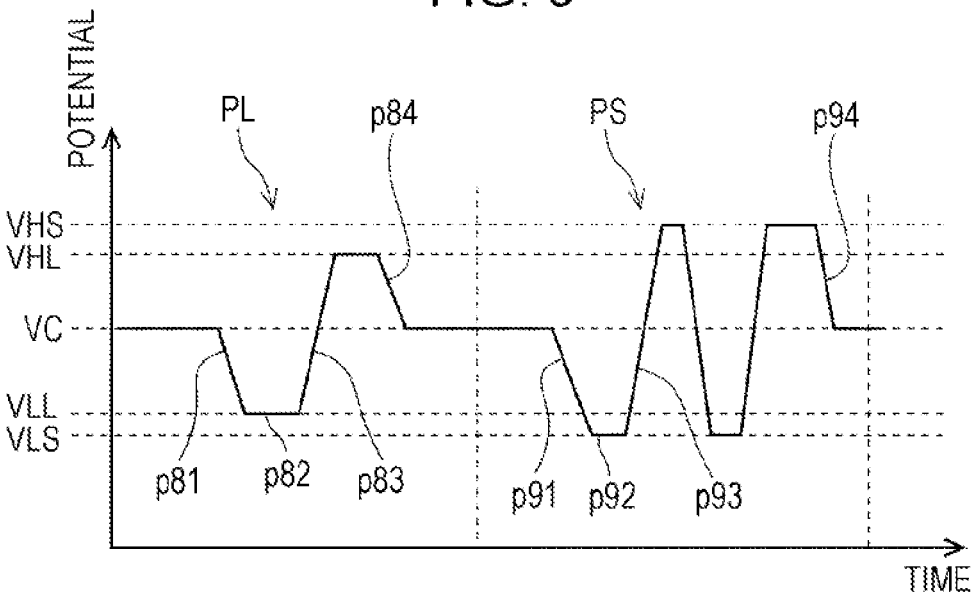
FIG. 9 is a schematic diagram that describes a configuration of a drive signal of the related art.

A piezoelectric body layer (a piezoelectric element 23) that is formed in this manner deforms due to the drive signal COM being applied thereto through a wiring member 41. More specifically, if a constant common potential is applied to a common electrode, and a fluctuating waveform is applied to an individual electrode, an electrical field that depends on a difference in potential is brought about between the two electrodes. The piezoelectric body layer bends and deforms depending on the intensity of the electrical field. FIG. 8 shows an example of piezoelectric properties of the piezoelectric body layer. Additionally, the horizontal axis of FIG. 8 represents a drive voltage (a difference in potential between the upper electrode film and the lower electrode film) that is applied to the piezoelectric body layer, and the vertical axis thereof represents an amount of displacement from a standard position of the piezoelectric body layer. As shown in FIG. 8, in the piezoelectric properties of the piezoelectric body layer in the present embodiment, there is a linear region L in the vicinity of where the drive voltage is 0. In this linear region L, the properties change in substantially linear form from partway through negative drive voltages to partway through positive drive voltages (a portion that is enclosed by a dashed line in FIG. 8). Regions of drive voltages that are yet further on the negative side or the positive side than the linear region L are non-linear regions in which the ratio of the amount of displacement with respect to the drive voltage becomes gradually smaller.

The piezoelectric body layer, that is, the piezoelectric element 23 bends and deforms depending on piezoelectric properties such as those mentioned above. That is, the higher the drive voltage (an application voltage) is set, the more a central portion of the piezoelectric body layer bends the nozzle plate 21, and deforms the elastic film 33 so as to reduce the capacity of the pressure chamber 26. On the other hand, the lower the drive voltage is set (the closer the drive voltage is to the drive voltage V1), the more a central portion of the piezoelectric body layer bends away from the nozzle plate 21, and deforms the elastic film 33 so as to increase the capacity of the pressure chamber 26. In this manner, since the capacity of the pressure chamber 26 changes when the piezoelectric element 23 is driven, the pressure of ink inside the pressure chamber 26 changes depending on this capacity change. Further, it is possible to cause ink droplets to be ejected from the nozzles 25 by controlling this pressure change (pressure fluctuation) in the ink.

Next, an electrical configuration of the recording head 6 will be described.

As shown in FIG. 1, the recording head 6 has a latch circuit 36, a decoder 37, a switch 38, and the piezoelectric element 23. The latch circuit 36, the decoder 37 and the switch 38 configure the head control unit 15, and the head control unit 15 is provided for each piezoelectric element 23, that is for each nozzle 25. The latch circuit 36 latches ejection data on the basis of print data. The ejection data is data that controls ejection and non-ejection of ink from each nozzle 25. The decoder 37 outputs a switch control signal that controls the switch 38 on the basis of the ejection data that is latched by the latch circuit 36. The switch control signal that is output from the decoder 37 is input to the switch 38. The switch 38 is a switch that is turned on and off depending on the switch control signal.

Figures 4, 5, 6:
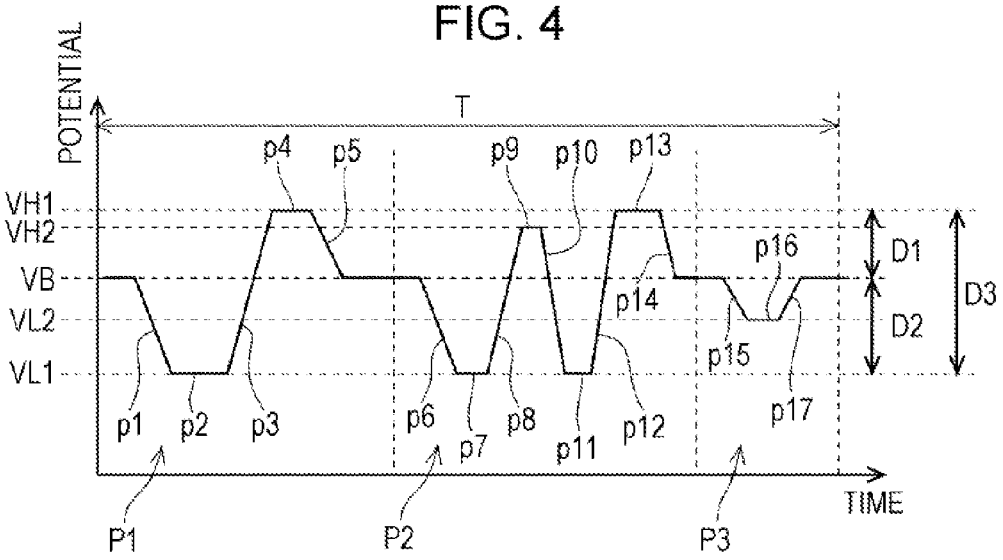
FIG. 4 is a waveform chart that describes a configuration of a drive signal.
FIG. 5 is a view that expresses a relationship between the vibration control element and an amount of mist.
FIG. 6 is a view that expresses a relationship between the vibration control element and a degree of variation in ink weight.

FIG. 4 is a waveform chart that describes a configuration of a drive signal COM (an oscillatory waveform). Additionally, in FIG. 4, the vertical axis represents potential, and the horizontal axis represents time. In the present embodiment, when the recording head 6 performs the ejection of ink while moving relatively with respect to the recording medium S, a unit period T (which is a periodicity of the drive signal COM) corresponds to a period of time in which the nozzle 25 moves by a distance that corresponds to a width of a pixel, which is a constitutional unit of an image. The drive signals COM are generated depending on a latch signal, which is a timing signal that is generated on the basis of an encoder pulse that depends on the scanning position of the recording head 6. Therefore, the drive signal COM is a signal that is generated at a period that is stipulated by the latch signal. The printer 1 in the present embodiment is capable of multi-gradation recording that forms dots of different sizes on the recording medium S, and in the present embodiment, is configured to be capable of a recording action with relatively large dots and relatively small dots. That is, the drive signal COM is a signal that generates a first drive pulse P1 that causes ink droplets to be ejected from the nozzles 25 and a second drive pulse P2 that causes ink droplets that are smaller than those of the first drive pulse P1 to be ejected from the nozzles 25 in this order.

The first drive pulse P1 is configured from a first expansion element p1, a first expansion retention element p2, a first contraction element p3, a first contraction retention element p4 and a first vibration control element p5. The first expansion element p1 is an element that causes the pressure chamber 26 to expand from the standard capacity by changing from the standard potential VB, which is a standard for changes in potential, to a first expansion potential VL1 (the lowest potential). The first expansion retention element p2 is an element that retains the expanded pressure chamber 26 for a set period of time by retaining the first expansion potential VL1. The first contraction element p3 is an element that causes the expanded pressure chamber 26 to contract by changing from the first expansion potential VL1 to a standard potential VB side, thereby causing ink to be ejected. The first contraction element p3 of the present embodiment causes a pressure chamber 26 to contract suddenly by changing from the first expansion potential VL1 to a first contraction potential VH1 (the highest potential) that exceeds the standard potential VB. The first contraction retention element p4 is an element that retains the contracted pressure chamber 26 for a set period of time by retaining the first contraction potential VH1. The first vibration control element p5 is an element that causes the contracted pressure chamber 26 to revert to the standard capacity by changing from the first contraction potential VH1, which corresponds to a state in which the pressure chamber 26 is contracted, to the standard potential VB, thereby suppressing pressure vibrations (residual vibrations) in the pressure chamber 26 that are brought about after the ejection of the ink droplets.

When this kind of first drive pulse P1 is applied to a piezoelectric element 23, ink droplets that are larger than those of the second drive pulse P2 are ejected from the nozzle 25. More specifically, firstly, when the first expansion element p1 is applied, a meniscus that is exposed in the nozzle 25 is drawn in toward the pressure chamber 26 side. This state is retained by the first expansion retention element p2. Subsequently, when the first contraction element p3 is applied, the pressure chamber 26 is contracted suddenly, and the pressure of ink inside the pressure chamber 26 is increased. As a result of this, a relatively large amount of ink droplets are ejected from the nozzle 25. After the ejection of the ink droplets, residual vibrations that are caused by the ejection of the ink droplets are brought about inside the pressure chamber 26. That is, the meniscus vibrates. Further, the vibrations of the meniscus are alleviated by the application of the first vibration control element p5. More specifically, after the first contraction element p3 is applied, by sequentially applying the first contraction retention element p4 and the first vibration control element p5, a force acts on a side that is opposite to (with respect to the meniscus) a movement direction of the meniscus and residual vibrations are controlled.

In addition, the second drive pulse P2 is configured from a second expansion element p6, a second expansion retention element p7, a second contraction element p8, a second contraction retention element p9, a second reexpansion element p10, a second reexpansion retention element p11, a second recontraction element p12, a second recontraction retention element p13 and a second vibration control element p14. The second expansion element p6 is an element that causes a pressure chamber 26 to expand from the standard capacity by changing from the standard potential VB, which is a standard for changes in potential, to a second expansion potential VL1 (the lowest potential) that is the same potential as the first expansion potential VL1. The second expansion retention element p7 is an element that retains the expanded pressure chamber 26 for a set period of time by retaining the second expansion potential VL1. The second contraction element p8 is an element that causes the expanded pressure chamber 26 to contract by changing from the second expansion potential VL1 to a standard potential VB side, thereby causing ink to be ejected. The second contraction element p8 of the present embodiment causes a pressure chamber 26 to contract suddenly by changing from the second expansion potential VL1 to a second low contraction potential VH2, which is a potential that exceeds the standard potential VB but is lower than the first contraction potential VH1. The second contraction retention element p9 is an element that retains the contracted pressure chamber 26 for a set period of time by retaining the second low contraction potential VH2. The second reexpansion element p10 is an element that causes the contracted pressure chamber 26 to expand again by changing from the second low contraction potential VH2 to a second reexpansion potential VL1. The second reexpansion retention element p11 is an element that retains a reexpanded pressure chamber 26 for a set period of time by retaining the second reexpansion potential VL1 for a set period of time. The second recontraction element p12 is an element that causes the expanded pressure chamber 26 to contract again by changing from the second reexpansion potential VL1 to a second contraction potential VH1 (the highest potential), which is the same potential as the first contraction potential VH1. The second recontraction retention element p13 is an element that retains a recontracted pressure chamber 26 for a set period of time by retaining the second contraction potential VH1 for a set period of time. The second vibration control element p14 is an element that causes the contracted pressure chamber 26 to revert to the standard capacity by changing from the second contraction potential VH1 to the standard potential VB.

When this kind of second drive pulse P2 is applied to a piezoelectric element 23, ink droplets that are smaller than those of the first drive pulse P1 are ejected from the nozzle 25. More specifically, firstly, when the second expansion element p6 is applied, a meniscus that is exposed in the nozzle 25 is drawn in toward the pressure chamber 26 side. This state is retained by the second expansion retention element p7. Subsequently, when the second contraction element p8 is applied, the pressure chamber 26 is contracted suddenly, and the pressure of ink inside the pressure chamber 26 is increased. As a result of this, ink in a central portion of the meniscus has a tendency to stretch in pillar form toward an ejection direction due to inertia. At this time, since the second reexpansion element p10 is applied after a contracted state of the pressure chamber 26 has been retained by the second contraction retention element p9, the pressure chamber 26 expands again, and the meniscus is drawn in a direction that is opposite a direction in which the ink has a tendency to extend. As a result of this, it becomes likely that a tip portion of an ink pillar will be cut off, and a relatively small amount of ink droplets are ejected. Thereafter, the pressure chamber 26 contracts due to the second reexpansion retention element p11 and the second recontraction element p12 being sequentially applied. The pressure chamber 26 is in a contracted state, but the second vibration control element p14 is applied after the retention by the second recontraction retention element p13. As a result of this, it is possible to suppress residual vibrations, that is vibrations of the meniscus, that are generated in the pressure chamber 26 after the ejection of the ink droplets.

Furthermore, an aperiodic pulse P3 is a drive pulse that is set to a waveform that is capable of causing a meniscus to vibrate to a degree at which ink is not ejected from the nozzle 25 in order to suppress the thickening of ink in the nozzle 25. More specifically, the aperiodic pulse P3 is configured from an aperiodic expansion element p15, an aperiodic expansion retention element p16 and an aperiodic reversion element p17. The aperiodic expansion element p15 is an element that causes a pressure chamber 26 to expand from the standard capacity to a slightly larger aperiodic expansion capacity by changing from a standard potential VB, which is a standard for changes in potential, to an aperiodic expansion potential VL2 that is higher than the second expansion potential VL1. The aperiodic expansion retention element p16 is an element that retains the expanded pressure chamber 26 for a set period of time by retaining the aperiodic expansion potential VL2. The aperiodic reversion element p17 is an element that causes a pressure chamber 26 that has expanded to the aperiodic expansion capacity to revert to the standard capacity by changing from the aperiodic expansion potential VL2 to the standard potential VB.

In this case, in the present embodiment, the VL1, which is the first expansion potential of the first drive pulse P1 and an initiation potential of the first contraction element p3, and the VL1, which is the second expansion potential of the second drive pulse P2 and an initiation potential of the second contraction element p8, are made to be uniform at the same potential. As a result of this, it is possible to make both the first expansion potential VL1 of the first drive pulse P1 (the initiation potential VL1 of the first contraction element p3 that causes ink to be ejected) and the second expansion potential VL1 of the second drive pulse P2 (the initiation potential VL1 of the second contraction element p8 that causes ink to be ejected) match an intended drive voltage in the piezoelectric properties of the piezoelectric body. As a result of this, it is possible to configure driving of the piezoelectric body by both of the drive pulses P1 and P2 to be optimal driving that matches the piezoelectric properties of the piezoelectric body. That is, in a case in which the standard potential VB is increased or decreased in order to adjust one drive pulse to an intended driving range in the piezoelectric properties, it is also possible to suppress the other drive pulse deviating from an intended range in the piezoelectric properties. In addition, since the expansion potentials VL1 of both of the drive pulses P1 and P2 (the initiation potentials VL1 of the contraction elements p3 and p8 that cause ink to be ejected) are made to be uniform, it is possible to use an effective drive voltage range in the piezoelectric properties of the piezoelectric body sufficiently in both of the drive pulses P1 and P2, and it is possible to suppress a circumstance in which the vibration control elements p5 and p14 deviate greatly on a high voltage side. As a result of this, since it is possible to suppress a circumstance in which the driving range of the piezoelectric properties of the vibration control elements p5 and p14 vary, it is possible to configure driving of the piezoelectric body using the vibration control elements p5 and p14 to a target extent, and it is possible to stabilize pressure fluctuations of the pressure chambers 26 due to the vibration control elements p5 and p14.

Further, in the first drive pulse P1, a difference in potential D1 between the standard potential VB and the first contraction potential VH1 is set to 40% or more and 50% or less with respect to a difference in potential D3 between the first expansion potential VL1 (the initiation potential VL1 of the first contraction element p3 that causes ink to be ejected) and the first contraction potential VH1, and is preferably set to 45%. In other words, in the first drive pulse P1, a difference in potential D2 between the first expansion potential VL1 (the initiation potential VL1 of the first contraction element p3) and the standard potential VB is set to 50% or more and 60% or less with respect to the difference in potential D3 between the first expansion potential VL1 (the initiation potential VL1 of the first contraction element p3) and the first contraction potential VH1, and is preferably set to 55%. In addition, in the second drive pulse P2, the difference in potential D1 between the standard potential VB and the second contraction potential VH1 is set to 40% or more and 50% or less with respect to the difference in potential D3 between the second expansion potential VL1 (the initiation potential VL1 of the second contraction element p8 that causes ink to be ejected) and the second contraction potential VH1, and is preferably set to 45%. In other words, in the second drive pulse P2, the difference in potential D2 between the second expansion potential VL1 (the initiation potential VL1 of the second contraction element p8) and the standard potential VB is set to 50% or more and 60% or less with respect to the difference in potential D3 between the second expansion potential VL1 (the initiation potential VL1 of the second contraction element p8) and the second contraction potential VH1, and is preferably set to 55%. By setting in this manner, it is possible to suppress a circumstance in which the intensity of the vibration control due to the vibration control elements p5 and p14 of both of the drive pulses P1 and P2 (the intensity of the pressure fluctuations that are brought about in ink inside the pressure chambers 26) becomes stronger than is necessary. As a result of this, it is possible to suppress a force that pulls the meniscus in a direction that is opposite a movement direction of the meniscus when residual vibrations are controlled, and it is possible to suppress the generation of mist. In particular, since a value of the difference in potential D1 is set to 40% or more and 50% or less with respect to the difference in potential D3, in addition to stabilizing pressure fluctuations in the pressure chambers 26 that result from the vibration control elements p5 and p14 in the abovementioned manner, it is possible to suppress the generation of mist and stabilize the ejection of the ink droplets. Additionally, in the first drive pulse and the second drive pulse, if, at least the initiation potentials of the contraction elements that cause ink to be ejected are made to be uniform, and the difference in potential D1 between the standard potential and the contraction potential is set to 40% or more and 50% or less with respect to the difference in potential D3 between the initiation potential of the contraction element and the contraction potential, it is possible to set other potentials as appropriate.

Next, the reason for setting the value of the difference in potential D1 to 40% or more and 50% or less with respect to the difference in potential D3 and preferably setting the value to 45% will be described. FIG. 5 summarizes the results of a printing experiment that examines a relationship between the intensity of vibration control due to the vibration control elements p5 and p14 of both of the drive pulses P1 and P2, that is, the difference in potential D1 between the standard potential VB and the contraction potential VH1 and a generation amount of mist, in table form. FIG. 6 summarizes the results of a printing experiment that examines a relationship between the difference in potential D1 between the standard potential VB and the contraction potential VH1 and a degree of variation in ink weight, in table form. Additionally, in the present experiment, the experiments were performed using the drive signal COM of the present embodiment under the following conditions of Table 1.

TABLE 1

| | |
|---|---|
| Frequency | 45 kHz |
| Surface Tension of Ink | 25 to 35 mN/m |
| Weight of Ink Droplets | First Drive Pulse P1: 6.5 ng, 7 ng<br>Second Drive Pulse P2: 3.5 ng, 1.7 ng |
| Speed of Ink Droplets | 8 to 9 m/s |
| Distance to Landing Target | 1.4 mm |

In the present experiment, so-called beta printing and single-pass printing that cover a predetermined region on a landing target with ink without intervals at a frequency of 45 kHz. In addition, the present experiment uses two types of ink that have surface tensions between 25 and 35 mN/m. In ejection that used the first ink, the difference in potential D3 of each pulse was adjusted so that ink droplets that were ejected using the first drive pulse P1 were 6.5 ng and ink droplets that were ejected using the second drive pulse P2 were 3.5 ng. In ejection that used the second ink, the difference in potential D3 of each pulse was adjusted so that ink droplets that were ejected using the first drive pulse P1 were 7 ng and ink droplets that were ejected using the second drive pulse P2 were 1.7 ng. In addition, the difference in potential D3 of each pulse and the slope of the waveform elements (a rate of change in potential) in both inks, and the like were adjusted so that a speed of the ink droplets that were ejected by the first drive pulse P1 and the second drive pulse P2 was 8 to 9 m/s. Furthermore, a distance from the nozzles 25 to the landing target is set as 1.4 mm. Further, variation in the amount of mist and weight of the ink droplets is measured by changing the difference in potential D1 between the standard potential VB and the contraction potential VH1 of both of the drive pulses P1 and P2 to between 37% to 53% with respect to the difference in potential D3 between expansion potential VL1 (the initiation potential VL1 of the contraction elements p3 and p8 that cause ink to be ejected) and the contraction potential VH1, and determination was performed using the "○", "Δ" and "x" symbols. Additionally, the detection of the amount of mist is performed by a humidity sensor that is installed in the periphery of the recording head 6. That is, changes in humidity in the periphery of the recording head 6 are detected by the humidity sensor, and the amount of mist is verified on the basis of changes in humidity. In addition, a discharge speed of ink droplets is measured, and the weight of the ink droplets is determined from a correlation between speed and weight. The discharge speed of the ink droplets is measured on the basis of an amount of received light by irradiating laser light so as to block out a pathway that leads down from the ink droplets, and monitoring an amount of irradiated laser light that is received.

In the measurement results of the amount of mist that is shown in FIG. 5, the "○" symbol indicates that the amount of mist is within a fluctuation range of 0 to 5%, and is within an allowable range. The "Δ" symbol indicates that the amount of mist is greater than the amount of mist that corresponds to the "○" symbol +5%, but within an amount that is equal to 10 times the amount of mist is greater than the amount of mist that corresponds to the "○" symbol. The "x" symbol indicates that the amount of mist is greater than 10 times the amount of mist that corresponds to the "○" symbol. As displayed in FIG. 5, it was found that the amount of mist that is generated along with the ejection of ink from the present experiment is closely related to the difference in potential D1 between the standard potential VB and the contraction potential VH1. More specifically, in a range in which a value of the difference in potential D1 is 50% or less with respect to the difference in potential D3, it was found that the amount of mist is "○", and a comparative amount of mist is reduced. On the other hand, in a range in which the value of the difference in potential D1 is 51% or more with respect to the difference in potential D3, it was found that the amount of mist is "Δ" or "x", and a comparative amount of mist is increased. This is because a force that pulls the meniscus becomes stronger due to the difference in potential D1 of the vibration control elements being larger, and it more likely that mist will be generated. Further, from these results, it is understood that it is preferable that the value of the difference in potential D1 be set to 50% or less with respect to the difference in potential D3 in order to suppress the amount of mist.

In addition, in the measurement results of the variation in the weight of ink droplets that is shown in FIG. 6, the "○" symbol indicates that the variation in the weight of ink droplets is within a range of ±15%. The "Δ" symbol indicates that the variation in the weight of ink droplets is within a range of 15% to 25%. The "x" symbol indicates that the variation in the weight of ink droplets exceeds 25%. As in the table of FIG. 6, in a range in which a value of the difference in potential D1 is 40% or more with respect to the difference in potential D3, it was found that the variation in the weight of ink droplets is "○", and it is possible to suppress variation in the weight of ink droplets. On the other hand, when the value of the difference in potential D1 is 39% or less with respect to the difference in potential D3, it was found that the variation in the weight of ink droplets is "Δ" or "x", and is increased. This is because it is no longer possible to sufficiently suppress residual vibrations due to the difference in potential D1 of the vibration control element being made to be small. That is, because ink droplets are ejected in a state in which the meniscus is unstable due to residual vibrations. Further, from these results, it is understood that it is preferable that the value of the difference in potential D1 be set to 40% or more with respect to the difference in potential D3 in order to suppress variation in the weight of ink droplets.

In this manner, if the value of the difference in potential D1 is set to 40% or more and 50% or less with respect to the difference in potential D3, it is possible to perform the ejection of the ink droplets in a stable manner by suppressing variation in the weight of ink droplets, and it is possible to suppress the generation of mist. In addition, if variation due to fabrication tolerance is taken into account, it is desirable to set the value of the difference in potential D1 to 45%, which is halfway between the range of 40% or more and 50% or less, with respect to the difference in potential D3.

Figure 7A:
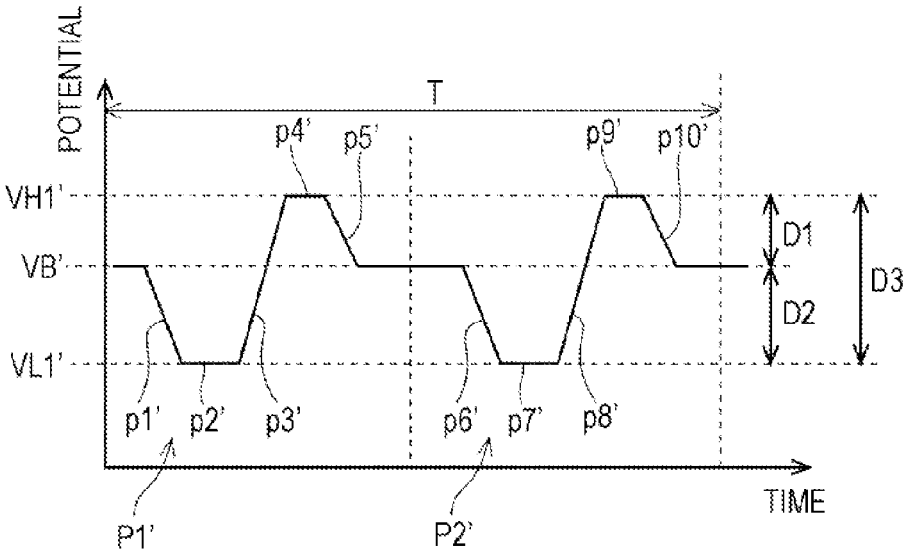
FIGS. 7A and 7B are waveform charts that describe configurations of drive signals in other embodiments.

Incidentally, the configuration of the drive signal COM is not limited to that mentioned above, and it is possible to adopt various configurations. For example, in the drive signal COM that is shown in FIG. 7A, a first drive pulse P1' and a second drive pulse P2' (that are included in the unit period T) have the same waveform. More specifically, the first drive pulse P1' and the second drive pulse P2' are configured from expansion elements p1' and p6', expansion retention elements p2' and p7', contraction elements p3' and p8', contraction retention elements p4' and p9' and vibration control elements p5' and p10'. Additionally, since both of the drive pulses P1' and P2' have the same configuration as the first drive pulse P1 of the first embodiment that is mentioned above, description thereof has been omitted.

Further, in the present embodiment, the expansion potential VL1' (the initiation potential VL1' of the contraction potential p3' that causes ink to be ejected) of the first drive pulse P1' and the expansion potential VL1' (the initiation potential VL1' of the contraction potential p8' that causes ink to be ejected) of the second drive pulse P2' are also made to be uniform at the same potential. In addition to this, a difference in potential D1 between a standard potential VB' and the contraction potential VH1' of both of the drive pulses P1' and P2' is set to 40% or more and 50% or less with respect to a difference in potential D3 between the expansion potential VL1' (the initiation potential VL1' of the contraction elements p3' and p8') and the contraction potential VH1', and is preferably set to 45%. As a result of this, since it is possible to suppress a circumstance in which the intensity of the vibration control becomes stronger than is necessary in addition to stabilizing pressure fluctuations of the pressure chamber 26 that result from the vibration control elements p5' and p10', it is possible to stabilize the ejection of the liquid droplets in addition to it being possible to suppress the generation of mist. In particular, as in the embodiments, in a case in which the drive signal COM is provided with the first drive pulse P1' and the second drive pulse P2' that cause a comparatively large amount of ink droplets to be ejected, there is a tendency for mist to be generated, and there is also a tendency for residual vibrations to become large, but it is possible to suppress the generation of mist by applying the present invention and it is possible to stabilize the ejection of the liquid droplets. Therefore, an effect that is superior to that of the above-mentioned embodiment can be expected from the present embodiment. Additionally, it is also possible to include an aperiodic pulse after the first drive pulse P1' and the second drive pulse P2' in the drive signal COM of the present embodiment.

Figure 7B:
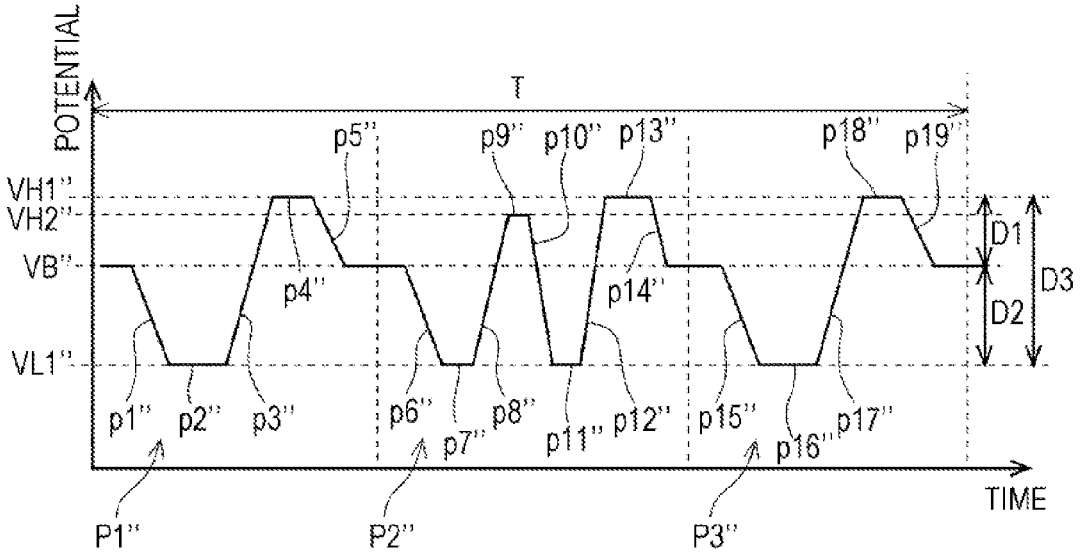

In addition, in the drive signal COM that is shown in FIG. 7B, a first drive pulse P1" and a third drive pulse P3" that are included in the unit period T have the same waveform. In addition, between the first drive pulse P1" and the third drive pulse P3", the drive signal COM is provided with a second drive pulse P2" that ejects ink droplets that are smaller than those that are ejected by the drive pulses P1" and P3". More specifically, the first drive pulse P1" is configured from a first expansion element p1", a first expansion retention element p2", a first contraction element p3", a first contraction retention element p4" and a first vibration control element p5". In addition, the second drive pulse P2" is configured from a second expansion element p6", a second expansion retention element p7", a second contraction element p8", a second contraction retention element p9", a second reexpansion element p10", a second reexpansion retention element p11", a second recontraction element p12", a second recontraction retention element p13" and a second vibration control element p14". Furthermore, the third drive pulse P3" is configured from a third expansion element p15", a third expansion retention element p16", a third contraction element p17", a third contraction retention element p18" and a third vibration control element p19". Additionally, since the first drive pulse P1" and the third drive pulse P3" have the same configuration as the first drive pulse P1 of the first embodiment that is mentioned above, and the second drive pulse P2" has the same configuration as the second drive pulse P2 of the first embodiment that is mentioned above, description thereof has been omitted.

Further, in the present embodiment, the expansion potential VL1" (the initiation potential VL1" of the first contraction potential p3" that causes ink to be ejected) of the first drive pulse P1", the expansion potential VL1" (the initiation potential VL1" of the second contraction potential p8" that causes ink to be ejected) of the second drive pulse P2", and the expansion potential VL1" (the initiation potential VL1"

of the third contraction potential p17" that causes ink to be ejected) of the third drive pulse P3", are made to be uniform at the same potential. In addition to this, a difference in potential D1 between a standard potential VB" and the contraction potential VH1" of each drive pulse P1", P2" and P3" is set to 40% or more and 50% or less with respect to a difference in potential D3 between the expansion potential VL1" (the initiation potential VL1" of the contraction elements p3", p8" and p17") and the contraction potential VH1", and is preferably set to 45%. As a result of this, since it is possible to suppress a circumstance in which the intensity of the vibration control becomes stronger than is necessary in addition to stabilizing pressure fluctuations of the pressure chamber 26 that result from the vibration control elements p5", p14" and p19", it is possible to stabilize the ejection of the liquid droplets in addition to it being possible to suppress the generation of mist. Additionally, it is possible to include an aperiodic pulse after the third drive pulse P3" in the drive signal COM of the present embodiment.

In addition, it is possible to adopt various configurations as the configuration of the drive pulses. In brief, a drive pulse of any configuration may be used as long as the drive pulse is provided with an expansion element that causes a pressure chamber 26 to expand by changing from the standard potential to an expansion potential, a contraction element that causes a pressure chamber 26 to contract, and a vibration control element that controls pressure vibrations (residual vibrations) of the pressure chamber 26 that are brought about after the ejection of ink by changing from a contraction potential to a standard potential, and is capable of causing ink to be ejected from a nozzle 25. In addition, the number of drive pulses that are included in the drive signal COM is not limited to two, and it is possible to include a plurality of drive pulses therein. In a drive signal COM that includes a plurality of drive pulses, the contraction potentials of the vibration control elements need not necessarily be made to be uniform at the same potential in all of the drive pulses. It is possible to set the contraction potential arbitrarily for each drive pulse if the difference in potential D1 between the standard potential and the contraction potential of each drive pulse is set to 40% or more and 50% or less with respect to the difference in potential D3 between the expansion potential (the initiation potential of the contraction elements that cause ink to be ejected) and the contraction potential. In addition, it is desirable to set a value of the difference in potential D1 of all of the abovementioned drive pulses to 40% or more and 50% or less with respect to the difference in potential D3, but it is feasible to set at least two of the drive pulses to this range. Naturally, it is most desirable to set the abovementioned value of the difference in potential D1 in all of the drive pulses to 45% with respect to the difference in potential D3. In addition, it is desirable to make the initiation potentials of the contraction potentials that cause ink to be ejected uniform at the same potential in all of the drive pulses, but it is feasible to make the initiation potentials of the contraction elements of at least two of the drive pulses uniform at the same potential.

Furthermore, a plurality of drive pulses may respectively eject ink droplets of different sizes. For example, it is possible to incorporate a large dot drive pulse that causes ink droplets that correspond to large dots to be ejected, a medium dot drive pulse that causes ink droplets that correspond to medium dots to be ejected, and a small dot drive pulse that causes ink droplets that correspond to small dots to be ejected in a unit period T of a drive signal COM. In a case of such a drive signal, since the size of the dots differs greatly, it is likely a range of changes in potential of the drive signal (a range from the highest potential to the lowest potential) differs for each drive pulse. Therefore, in the related art, when the driving of the piezoelectric body by a single drive pulse was optimized by increasing or decreasing the standard potential, there was a tendency for driving of the piezoelectric body by other drive pulses, and the vibration control elements in particular, to deviate from optimal driving conditions. However, in the present embodiment, since the expansion elements (the initiation potentials of the contraction elements that cause ink to be ejected) of each drive pulse are made to be uniform, it is possible to suppress a circumstance in which driving of the piezoelectric body by other drive pulses deviates from optimal driving conditions. In particular, it is possible to configure driving of the piezoelectric body by the vibration control elements as intended. As a result of this, it is possible to suppress a circumstance in which the driving range in the piezoelectric properties of the vibration control elements varies for each piezoelectric body, and it is possible to stabilize pressure fluctuations of the pressure chamber 26 due to the vibration control elements. Additionally, for example, it is possible to use the abovementioned first drive pulse P1 of the first embodiment as a large dot drive pulse and the second drive pulse P2 as a small dot drive pulse. In this case, the medium dot drive pulse corresponds to the third drive pulse in the present invention.

Further, an ink jet recording apparatus 1 that is provided with an ink jet recording head 6 that is one type of liquid ejecting head has been described above, but it is also possible to apply the present invention to other liquid ejecting head that are configured to bring about pressure fluctuations in a pressure chamber by causing a piezoelectric body to deform, and driving methods for liquid ejecting heads. For example, it is also possible to apply the present invention to filter liquid ejecting apparatuses that are provided with color material ejecting heads that are used in the production of color filters such as liquid crystal displays, electrode material ejecting heads that are used in electrode formation such as organic EL (Electro Luminescence) displays, FED (Field Emission Displays) and the like, organic material ejecting heads that are used in the production of biochips (biotips) and the like, and driving method of liquid ejecting apparatuses.

The entire disclosure of Japanese Patent Application No. 2013-167394, filed Aug. 12, 2013 and 2014-031305, filed Feb. 21, 2014 are expressly incorporated by reference herein.

What is claimed is:

1. A liquid ejecting apparatus comprising:

a liquid ejecting head that has a piezoelectric body that deforms due to a drive signal being applied thereto, and is capable of ejecting liquid droplets from nozzles by bringing about a pressure fluctuation in a liquid inside a pressure chamber by using the deformation of the piezoelectric body; and a drive signal generator that generates the drive signal, wherein the drive signal includes a first drive pulse that causes liquid droplets to be ejected from the nozzles and a second drive pulse that causes liquid droplets of a different size from those of the first drive pulse to be ejected from the nozzles, wherein the first drive pulse and the second drive pulse have at least an expansion element that causes the pressure chamber to expand from a standard capacity by changing from a standard potential, which is a standard for changes in potential, to an expansion potential, a contraction element that causes the pressure chamber to contract by exceeding the standard potential from a potential that is on an expansion potential side of the standard potential, thereby ejecting the liquid, and a vibration control element that controls pressure vibrations in the pressure chamber that are brought about after the ejection of the liquid by changing from a contraction potential to the standard potential, wherein an initiation potential of the contraction element of the first drive pulse and an initiation potential of the contraction element of the second drive pulse are made to be uniform at the same potential, wherein an initiation potential for the expansion element of the first drive pulse and an initiation potential of the expansion element of the second drive pulse are made to be uniform at the standard potential, wherein the expansion element of the first drive pulse changes from the standard potential to the initiation potential of the contraction element of the first drive pulse directly without a hold element and the expansion element of the second drive pulse changes from the standard potential to the initiation potential of the contraction element of the second drive pulse directly without a hold element, and wherein in the first drive pulse and the second drive pulse, a difference in potential between the standard potential and the contraction potential is set to 40% or more and 50% or less with respect to a difference in potential between the initiation potential of the contraction element and the contraction potential.

2. The liquid ejecting apparatus according to claim 1, wherein the drive signal includes a third drive pulse that causes liquid droplets of the same size as those of the first drive pulse to be ejected from the nozzles, wherein the third drive pulse has at least an expansion element that causes the pressure chamber to expand from a standard capacity by changing from a standard potential, which is a standard for changes in potential, to an expansion potential, a contraction element that causes the pressure chamber to contract by exceeding the standard potential from a potential that is on an expansion potential side of the standard potential, thereby ejecting the liquid, and a vibration control element that controls pressure vibrations in the pressure chamber that are brought about after the ejection of the liquid by changing from the contraction potential to the standard potential, standard potential, which is a standard for changes in potential, wherein an initiation potential of the contraction element of the third drive pulse is made to be uniform at the same potential as the initiation potential of the contraction element of the first drive pulse and the initiation potential of the contraction element of the second drive pulse, and wherein in the third drive pulse, a difference in potential between the standard potential and the contraction potential is set to 40% or more and 50% or less with respect to a difference in potential between the initiation potential of the contraction element and the contraction potential.

3. The liquid ejecting apparatus according to claim 2, wherein the first drive pulse and the third drive pulse cause liquid droplets that are larger than those of the second drive pulse to be ejected from the nozzles.

4. The liquid ejecting apparatus according to claim 1, wherein each drive pulse is set so that the difference in potential between the standard potential and the contraction potential is 45% with respect to the difference in potential between the initiation potential of the contraction element and the contraction potential.

5. The liquid ejecting apparatus according to claim 1, wherein the piezoelectric body is formed in a film-shape in which crystal is preferentially oriented.

* * * * *